US008191263B2

(12) United States Patent
Follo et al.

(10) Patent No.: US 8,191,263 B2
(45) Date of Patent: Jun. 5, 2012

(54) SEPARABLE LUBRICATION

(75) Inventors: Thomas A. Follo, North Milford, CT (US); Paul D. Richard, Shelton, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 438 days.

(21) Appl. No.: 12/434,309

(22) Filed: May 1, 2009

(65) Prior Publication Data

US 2010/0107416 A1 May 6, 2010

Related U.S. Application Data

(60) Provisional application No. 61/049,608, filed on May 1, 2008.

(30) Foreign Application Priority Data

May 1, 2009 (WO) ..... PCT/US2009/042579

(51) Int. Cl.

| | |
|---|---|
| ***B26B 19/44*** | (2006.01) |
| ***B26B 21/00*** | (2006.01) |
| ***B26B 21/14*** | (2006.01) |
| ***B26B 21/52*** | (2006.01) |

(52) U.S. Cl. ..... 30/41; 30/32; 30/57; 30/77; 30/527; 30/538

(58) Field of Classification Search ..... 30/32, 41, 30/50, 73, 77, 79, 526, 527, 537, 538, 540, 30/57

See application file for complete search history.

(56) References Cited

U.S. PATENT DOCUMENTS

| | | | | | |
|---|---|---|---|---|---|
| 637,124 | A | * | 11/1899 | Johnson | 30/32 |
| 969,724 | A | * | 9/1910 | Pratt | 30/51 |
| 1,008,929 | A | * | 11/1911 | Smith et al. | 30/51 |
| 2,035,111 | A | * | 3/1936 | Behrman | 30/59 |
| 2,602,221 | A | * | 7/1952 | Ewing et al. | 30/36 |
| 3,517,442 | A | * | 6/1970 | Regan | 30/41 |
| 3,895,437 | A | * | 7/1975 | DiBuono | 30/537 |
| 4,023,269 | A | * | 5/1977 | Lopez, Jr. | 30/41 |
| 4,574,476 | A | * | 3/1986 | Ortiz | 30/47 |
| 4,625,402 | A | * | 12/1986 | Kavoussi | 30/41 |
| 4,813,131 | A | * | 3/1989 | Gruner | 30/50 |
| 4,860,449 | A | * | 8/1989 | Duncan | 30/47 |
| 4,944,090 | A | * | 7/1990 | Sumnall | 30/41 |
| 5,092,041 | A | * | 3/1992 | Podolsky | 30/41 |
| 5,903,979 | A | * | 5/1999 | Oldroyd | 30/41 |
| 6,807,739 | B2 | * | 10/2004 | Follo | 30/527 |
| 6,935,032 | B2 | * | 8/2005 | Follo | 30/531 |
| 6,941,659 | B2 | * | 9/2005 | Gilder | 30/34.2 |
| 7,367,125 | B2 | * | 5/2008 | Aviza | 30/34.05 |
| 7,540,088 | B2 | * | 6/2009 | Takeshita | 30/34.2 |

(Continued)

*Primary Examiner* — Boyer D Ashley
*Assistant Examiner* — Samuel A Davies
(74) *Attorney, Agent, or Firm* — Energizer Personal Care, LLC

(57) ABSTRACT

A shaving implement which includes a handle. The shaving cartridge includes a frame and a separable lubrication. The separable lubrication includes a shaving aid. The shaving cartridge is pivotable relative to the handle between a neutral position (see e.g., FIG. 1) and a rearward position (see e.g, FIG. 2), and the separable lubrication is pivotable relative to the frame between a forward position (see e.g., FIGS. 1 and 2) and a locked position. During normal shaving, the separable lubrication is rotated toward the forward position and can pivot relative to the handle with the frame. When the separable lubrication is in the locked position, the separable lubrication is located in a position away from the skin during normal shaving and the pivoting of the frame relative to the handle is generally limited, or altogether eliminated.

15 Claims, 5 Drawing Sheets

U.S. PATENT DOCUMENTS

| | | | | |
|---|---|---|---|---|
| 7,690,122 | B2 * | 4/2010 | Worrick et al. | 30/526 |
| 7,703,361 | B2 * | 4/2010 | Johnson et al. | 83/13 |
| 7,877,879 | B2 * | 2/2011 | Nakasuka | 30/41 |
| 7,913,393 | B2 * | 3/2011 | Royle et al. | 30/50 |
| 7,954,244 | B2 * | 6/2011 | Orloff et al. | 30/50 |
| 2002/0116822 | A1 * | 8/2002 | Coffin | 30/34.2 |
| 2003/0208907 | A1 * | 11/2003 | Brown et al. | 30/50 |
| 2003/0213130 | A1 * | 11/2003 | Motta | 30/50 |
| 2005/0126007 | A1 * | 6/2005 | Aviza | 30/41 |
| 2006/0080837 | A1 * | 4/2006 | Johnson et al. | 30/50 |
| 2006/0143925 | A1 * | 7/2006 | Johnson et al. | 30/50 |
| 2007/0062047 | A1 * | 3/2007 | Zhuk et al. | 30/346.53 |
| 2007/0220751 | A1 * | 9/2007 | Gratsias et al. | 30/32 |
| 2008/0209734 | A1 * | 9/2008 | Nicoll | 30/41 |
| 2008/0250646 | A1 * | 10/2008 | Nakasuka | 30/41 |
| 2008/0256800 | A1 * | 10/2008 | Nicoll | 30/50 |
| 2009/0188112 | A1 * | 7/2009 | Prochaska et al. | 30/34.05 |
| 2009/0249628 | A1 * | 10/2009 | Hosseini et al. | 30/41 |
| 2009/0307908 | A1 * | 12/2009 | Nakasuka | 30/41 |
| 2010/0011583 | A1 * | 1/2010 | Efthimiadis et al. | 30/34.1 |
| 2010/0011584 | A1 * | 1/2010 | Efthimiadis et al. | 30/34.1 |
| 2010/0077619 | A1 * | 4/2010 | Follo et al. | 30/50 |
| 2010/0083505 | A1 * | 4/2010 | Royle et al. | 30/50 |
| 2010/0229397 | A1 * | 9/2010 | Nakasuka | 30/50 |
| 2011/0016724 | A1 * | 1/2011 | Murgida | 30/50 |
| 2011/0099815 | A1 * | 5/2011 | Burgio et al. | 30/41 |
| 2011/0119922 | A1 * | 5/2011 | Ntavos et al. | 30/32 |

* cited by examiner

SEPARABLE LUBRICATION

CROSS-REFERENCE TO RELATED APPLICATIONS

This application hereby claims priority to U.S. Provisional Application No. 61/049,608, filed on May 1, 2008.

BACKGROUND OF THE INVENTION

1. Field of Endeavor

The present invention relates to shaving implements in general, and, more particularly, to shaving implements having separable lubrication.

2. Background Information

Shaving implements generally include a shaving cartridge and a handle. The shaving cartridge can be fixedly, or pivotally, attached to the handle. In addition, the shaving cartridge might be affixed to the handle such that, once spent, a used shaving cartridge can be replaced with a new shaving cartridge on the same handle. Such handles and shaving cartridges are often referred to as "system razors." Alternatively, the shaving cartridge can be affixed to the handle such that it is not intended to be removed from the handle during normal use and; once the shaving cartridge is spent, the entire shaving implement is discarded and an entirely new shaving implement is used in the now-discarded shaving implement's place. Such shaving implements are often referred to as "disposable razors."

Shaving cartridges generally include a guard, a cap, and at least one blade. Prior art guards are located forward of the blade(s) and acts to flatten and/or pre-stretch the skin prior to encountering the blade. Prior art caps are located aft of the blade(s) and, in addition to flattening the skin after the skin has been shaved, can also provide lubrication and/or other shaving aids to the recently-shaved skin. Typically, the lubrication and/or shaving aids are provided by a lubrication strip that is affixed to the cap.

Although the cap and/or lubrication strip are successful in providing comfort to the recently shaved skin, they can often hinder the shaving process. For example, when shaving hard to reach areas (e.g., under the nose) or areas that require precision (e.g., sideburns), the cap can often physically impede the accurate placement of the razor blades on the desired location and/or make it difficult to pre-determine exactly where the blade(s) will contact the skin and begin shaving. Such difficulties can lead to areas of the skin left unshaven, as well as areas shaven where the user did not wish to shave.

In addition, the pivoting cartridge can make precision shaving and trimming difficult since many users often press harder when carefully trimming certain areas. Pressing a pivoting cartridge too hard against a user's skin can often lead to the razor cartridge pivoting away from the face. Such "over pivoting" can cause the razor blades of a cartridge to lose contact with the skin, leaving behind a poor shave.

Therefore, it is desirable to provide a shaving implement that overcomes the noted shortcomings in the prior art.

DISCLOSURE OF THE INVENTION

According to one aspect of the present invention, a shaving implement includes a shaving cartridge and a handle. The shaving cartridge includes a frame and a separable lubrication. The frame includes a guard and at least one razor blade. The separable lubrication includes a shaving aid that is dispensed onto the skin during normal shaving. The shaving cartridge is pivotable relative to the handle between a neutral position (see e.g., FIG. 1) and a rearward position (see e.g, FIG. 2), and the separable lubrication is pivotable relative to the frame between a forward position (see e.g., FIGS. 1 and 2) and a locked position.

During normal shaving, the separable lubrication is rotated toward the forward position and can pivot relative to the handle with the frame. In preparation for trimming, the separable lubrication is pivoted rearward relative to the frame until the frame reaches the rearward position (see again e.g., FIG. 2). As the separable lubrication continues to pivot toward the locked position, the frame is forced to pivot forward toward the neutral position and to the frame lock position (see e.g., FIGS. 6 and 7), which can be at or near the neutral position. When the separable lubrication is in the locked position, and the frame is in the frame lock position, the separable lubrication is located in a position away from the skin during normal shaving. In addition, when the separable lubrication is in the locked position, the pivoting of the frame relative to the handle is generally limited, or altogether eliminated.

According to another aspect of the present invention, the shaving aid can be in the form of a strip.

According to a further aspect of the present invention, the shaving aid can be included in an inner core that is at least partially encased within a plastic outer shell. In such an embodiment, the plastic outer shell includes holes that permit water to enter into the plastic outer shell, mix with the shaving aid, and then exit back through the holes and onto the skin during normal shaving. The holes can be arranged in any known manner, such as in an array (see e.g., FIGS. 8 and 13). The top portion can further include a tab.

One advantage of the present invention is that the shaving cartridge frame is pivots less when the separable lubrication is in the locked position. This generally provides more control and enables a user to press harder when shaving areas that are difficult to see or require precision.

Another advantage of the present invention is that the separable lubrication is rotated away from the shaving cartridge frame for trimming operations, which enables the user to see the area be shaved more clearly.

A third advantage of the present invention is that the separable lubrication, when in the forward position, provides shaving aid to the skin being shaved during normal shaving.

These and other advantages will become even more apparent in light of the included drawings and descriptions.

DETAILED DESCRIPTION OF THE INVENTION

Figure 1:
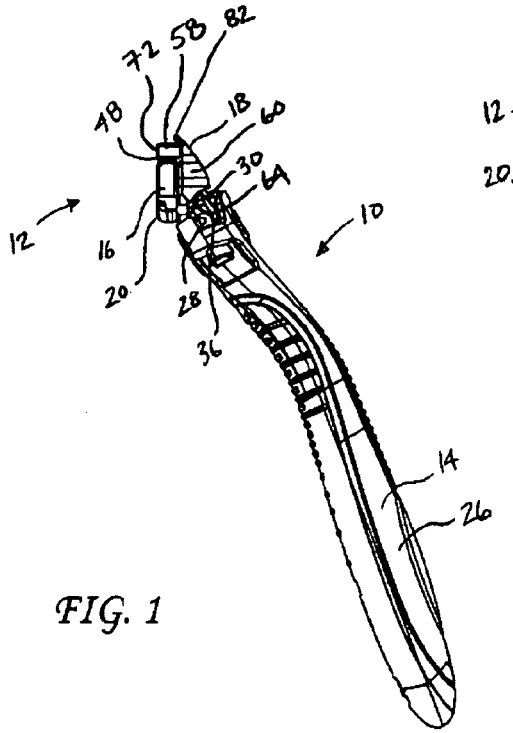
FIG. 1 is a side view of one embodiment of the shaving implement of the present invention wherein the shaving cartridge is in the neutral position.
Figure 2:
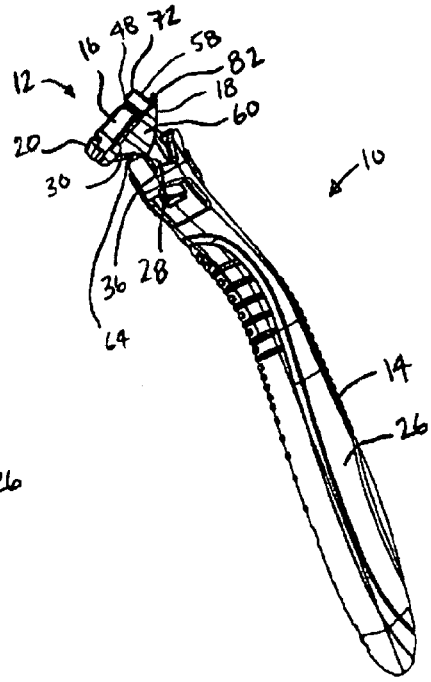
FIG. 2 is a side view of the embodiment of the present invention of FIG. 1 wherein the shaving cartridge is rotated to the rearward position.
Figure 3:
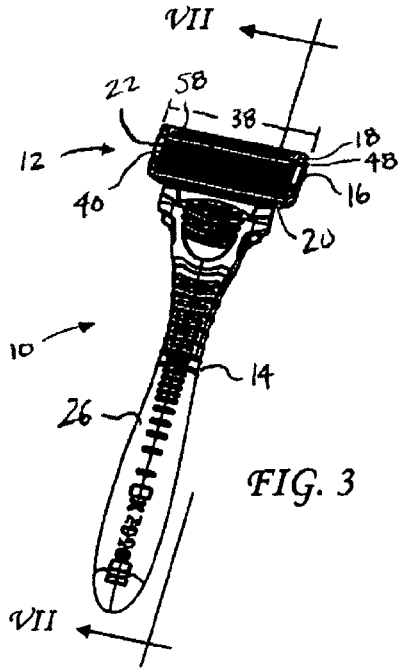
FIG. 3 is an isometric view of the front side of one embodiment of the present invention.
Figure 4:
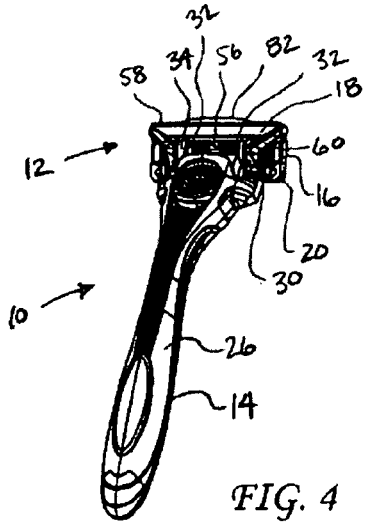
FIG. 4 is an isometric view of the rear side of one embodiment of the present invention.
Figure 5:
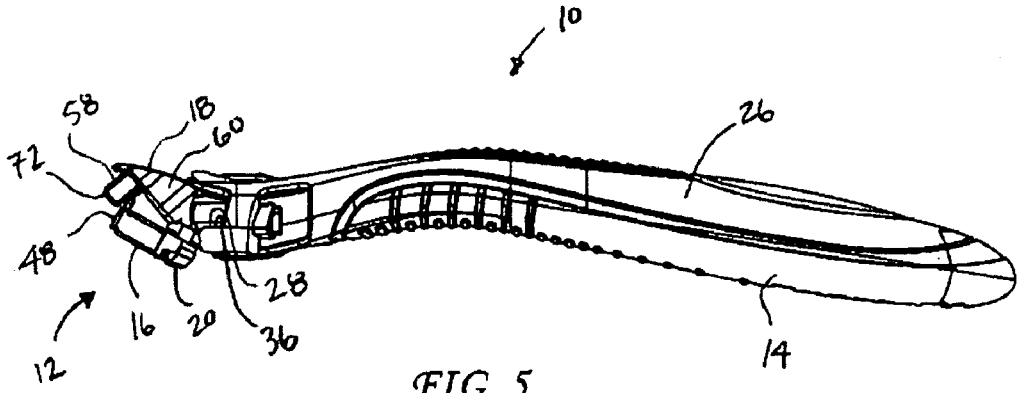
FIG. 5 is a side view of the embodiment of FIG. 1 wherein the separable lubrication of the shaving cartridge is rotated away from the frame of the shaving cartridge.

Referring to FIGS. 1-7, the shaving implement of the present invention is referred to as numeral 10. The shaving implement 10 comprises a shaving cartridge 12 and a handle 14. The shaving cartridge 12 includes a frame 16 and a separable lubrication 18. The frame 16 includes a guard 20 and at least one razor blade 22. The separable lubrication 18 includes a shaving aid 24 that is dispensed onto the skin during normal shaving. The shaving cartridge 12 is pivotable relative to the handle 14 between a neutral position (see e.g., FIG. 1) and a rearward position (see e.g, FIG. 2) and the separable lubrication 18 is pivotable relative to the frame 16 between a forward position (see e.g., FIGS. 1 and 2) and a locked position (see e.g., FIGS. 6 and 7). During normal shaving, the separable lubrication 18 is rotated toward the forward position and can pivot relative to the handle 14 with the frame 16. In preparation for trimming, the separable lubrication 18 is pivoted rearward relative to the frame 16 until the frame 16 reaches the rearward position (see again e.g., FIG. 2). As the separable lubrication 18 continues to pivot toward the locked position, the frame 16 is forced to pivot forward toward the neutral position and to the frame lock position (see e.g., FIGS. 6 and 7), which can be at or near the neutral position. When the separable lubrication 18 is in the locked position, and the frame 16 is in the frame lock position, the separable lubrication is located in a position away from the skin during normal shaving.

Referring now to, for example, FIGS. 1-4, a handle 14 is shown. The handle 14 includes a grip portion 26, a contact surface 28 and connectors 30 for attaching the handle 14 to the shaving cartridge 12. Any suitable connectors 30 can be used; however, as shown in the embodiment of FIGS. 1-4, outward facing arms 32 are utilized for this purpose. The outward facing arms 32 correspond to shell bearings 34 on the frame 16 (discussed infra.). The handle 14 includes a contact surface 28 that provides a surface that contacts the separable lubrication 18 when a user places the separable lubrication 18 in the locked position. The contact surface 28 can be any desired shape; however, as shown in FIGS. 1-4, the contact surface 28 includes a substantially flat wall 36.

Referring now to FIGS. 1-9, the frame 16 defines a length 38 and has an opening 40 sized for blade(s) 22 to be positioned therein. The blade(s) 22 can be contained within the frame 16 by any known means. The frame 16 can include a guard 20, as well. The guard 20 can be integrally formed on the frame 16, or can be directly, or indirectly, attached to the frame 16. The guard 20 serves the general purpose of pre-stretching the skin prior to the skin being shaved approaching the one or more blades 22. The guard 20 also sets the position of the skin so that it approaches the blade(s) 22 at the correct angle. As shown especially well in FIG. 8, the frame 16 can be made of several distinct pieces. However, the invention should not be considered to be so limited, as the frame 16 can likewise be formed from a single, unitary piece.

The blade(s) 22 are generally made of stainless steel and are rectilinear so that they can be positioned lengthwise in the frame 16; however, the blades 22 of the present invention should not be considered to be so limited. For example, the blades 22 can be made of a material other than steel and/or can be curved (not shown). A foil (not shown) having rounded holes with sharpened edges can also be used. Each of the blade(s) 22 includes a sharpened cutting edge 46. The cutting edge(s) 46 can include additional coatings that are known to improve characteristics such as sharpness, lubricity and/or durability. As noted above, the frame 16 includes one or more blades 22. Accordingly, the frame of the present invention can include one, two, three, four, five, six, seven, or more blades 22 without departing from the scope of the present invention.

The frame 16 includes a rear edge 48 that is located aft of the blades 22. Generally, the rear edge 48 is as close to the aft-most blade 22 as possible. For example, the rear edge 48 is preferably less than 3 mm from the cutting edge 46 aft most blade 22, and more preferably less than 2 mm therefrom. Preferably, the rear edge 48 is made of metal so that it is thin, yet still provides the necessary structural stability; however, the rear edge 48 of the frame 16 can be made of any suitable material (e.g., plastic).

The frame 16 includes pivoting means 50 that enable the frame 16, and the remaining portions of the shaving cartridge 12, to pivot relative to the handle 14. The pivoting means 50 can be integral with the frame 16. For example, the pivoting means 50, as shown particularly well in FIGS. 1, 2 and 9, can be shell bearings 34 that mate with corresponding connectors 30 (e.g., outward facing arms 32) on the handle 14. Alternatively, the pivoting means 50 can be indirectly attached to the frame 16 (e.g., located on the handle). The pivoting means 50 enable the frame 16 to pivot between a neutral position (see e.g., FIG. 1) and a rearward position (see e.g., FIG. 2). In the embodiment shown, the neutral position is defined by a front stop 52 (see e.g., FIG. 9) on the shell bearing 34 of the frame 16 and the rearward position is defined by a rear stop 54 (see e.g., FIG. 9) on the shell bearing 34. Generally, the rearward position is approximately 60 degrees aft of the neutral position; however, the present invention is not so limited and the rearward position can be more, or less, than 60 degrees aft of the neutral position. The handle 14 can include frame biasing means 56 (e.g., a spring-loaded plunger 57) that biases the frame 16 toward the neutral position. Alternatively, the frame biasing means 56 can be located on the shaving cartridge 12 (not shown) and act (directly or indirectly) against the handle 14 to bias the frame 16 towards the neutral position. In some embodiments, the frame 16 can also pivot forward of the neutral position (not shown).

Figure 9:
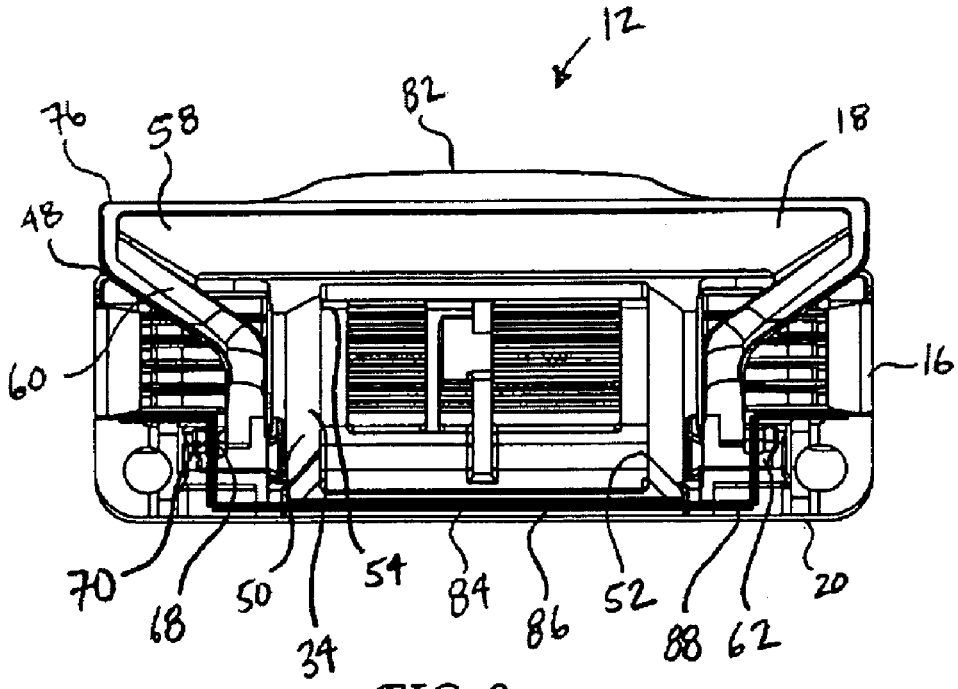
FIG. 9 is a rear view of one embodiment of a shaving cartridge of the present invention.
Figure 10:
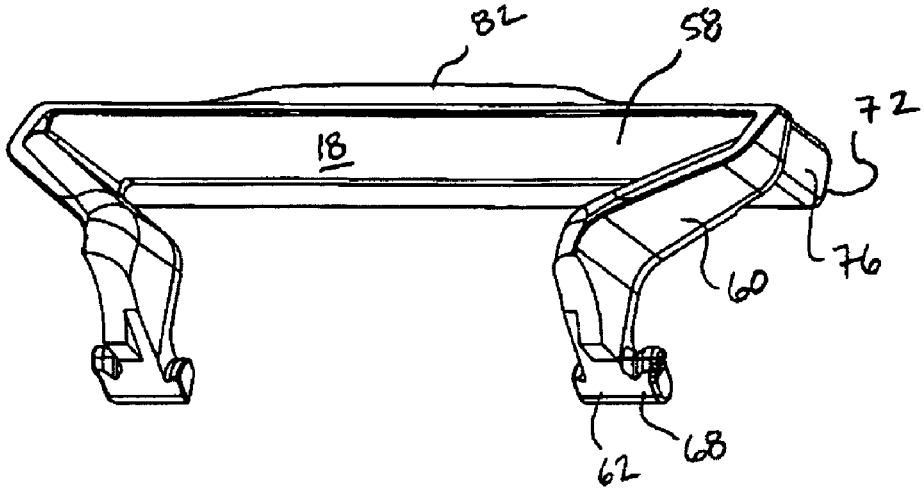
FIG. 10 is an isometric view of the rear of the separable lubrication.
Figure 11:
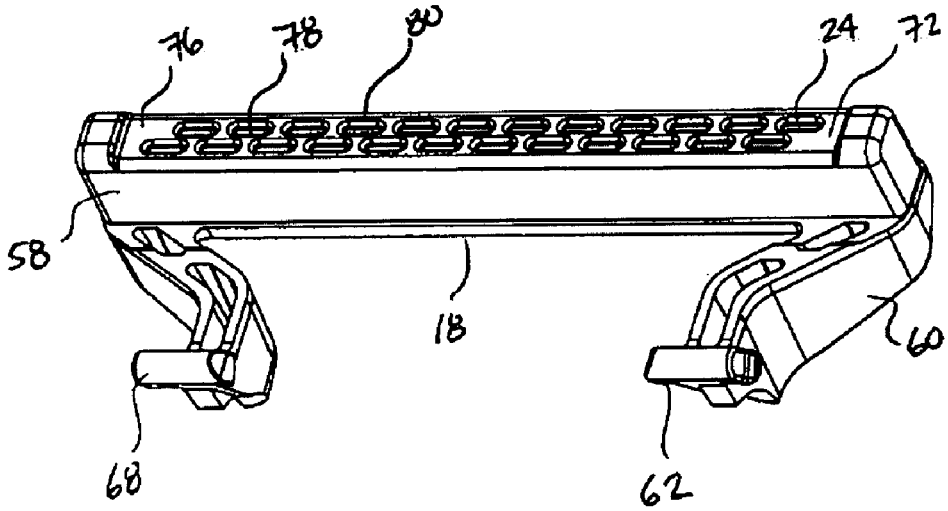
FIG. 11 is an isometric view of the front of the separable lubrication.

Referring now to FIGS. 1-11, the separable lubrication 18 includes a top portion 58 and at least one arm 60. The top portion 58 includes a skin-engaging member 72. The arm(s) 60 include attachment means 62 for connecting, directly or indirectly, the separable lubrication 18 to the frame 16 and have a front surface 64. The attachment means 62 enables the separable lubrication 18 to pivot relative to the frame 16 between a forward position (see e.g., FIGS. 1 and 2) and a locked position (see e.g., FIGS. 6 and 7). As shown in FIGS. 10 and 11, the attachment means 62 includes pins 68 that are received in corresponding holes 70 in the frame 16. However, any suitable attachment means that both attach the separable lubrication 18 to the frame 16 and permit pivotal motion relative to the frame 16 can be utilized. As shown in FIGS. 10 and 11, there can be two arms 60; however, one, three or more arms 60 can also be utilized.

Figure 13:
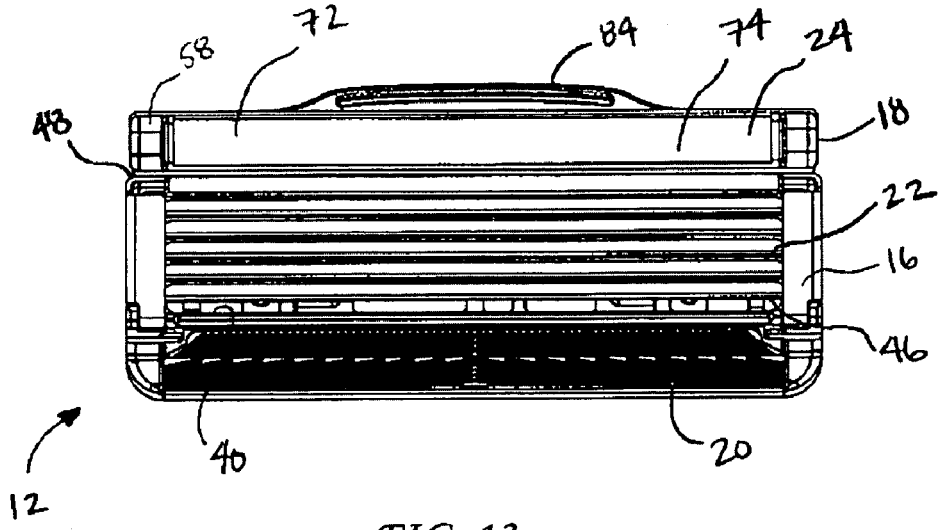
FIG. 13 is a front view one embodiment of a shaving cartridge of the present invention having a shaving aid strip.

The top portion 58 of the separable lubrication 18 includes a skin-engaging member 72 that is in contact with the skin during normal shaving. The skin engaging member 72 delivers a shaving aid 24 to the skin being shaved during normal shaving. The shaving aid 24 can be in any substance that improves the shaving performance of the shaving device. The shaving aid 24 can be in the form of a strip 73 (see e.g., FIG. 13), or any other known form. As shown in, for example, FIGS. 7 and 8, the top portion 58 of the separable lubrication 18 includes a plastic outer shell 76 with an inner core 78 that at least partially fills the outer shell 76 with shaving aid 24. The skin-engaging member 72 of the top portion 58 includes holes 80 that permit water to enter into the plastic outer shell 76, mix with the shaving aid 24, and then exit back through the holes 80 and onto the skin during normal shaving. The holes can be arranged in any known manner, such as in an array (see e.g., FIGS. 8 and 13). The top portion 58 can further include a tab 82.

Figure 12:
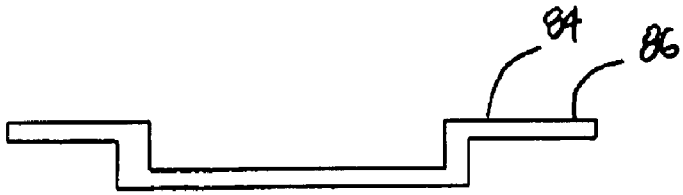
FIG. 12 is a front view of the spring.

In one embodiment, a cartridge spring 84 is provided that biases the separable lubrication 18 toward the forward position of the frame 16. As shown in FIGS. 9 and 12, the cartridge spring 84 is shown generally as a leaf spring 86; however, any type of spring (e.g., torsional, compression) can be used. When in the forward position, the skin-engaging member 72 of the top portion 58 of the separable lubrication 18 is co-planar with the cutting edge 46 of blade(s) 22 such that the blades 22 and the skin-engaging member 72 are both in contact with the skin during normal shaving. The top portion 58, when in the forward position is preferably immediately aft of the rear edge 48 of the frame 16, such that the shaving aid 24 is delivered immediately after the blade(s) 22 have shaved the skin.

Figure 6:
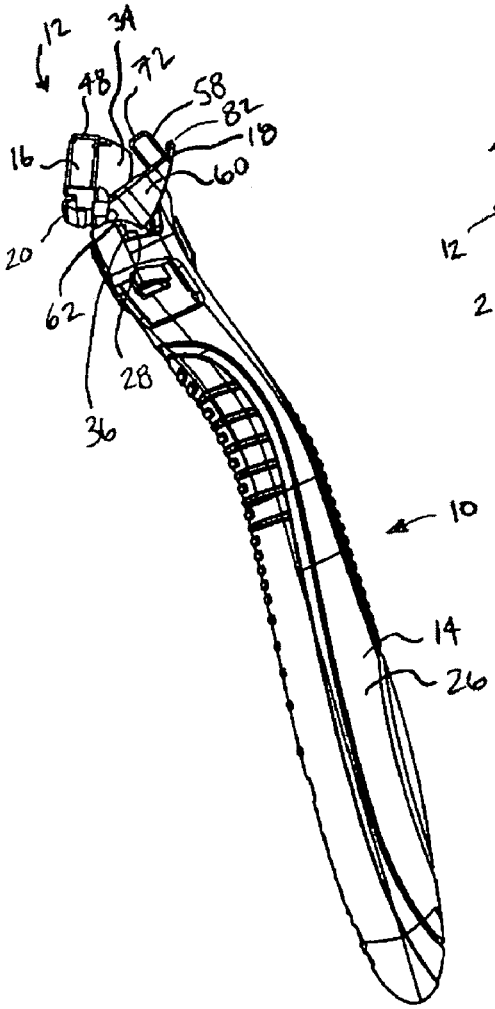
FIG. 6 is a side view of the embodiment of FIG. 1 wherein the separable lubrication and the frame are in the locked position.
Figure 7:
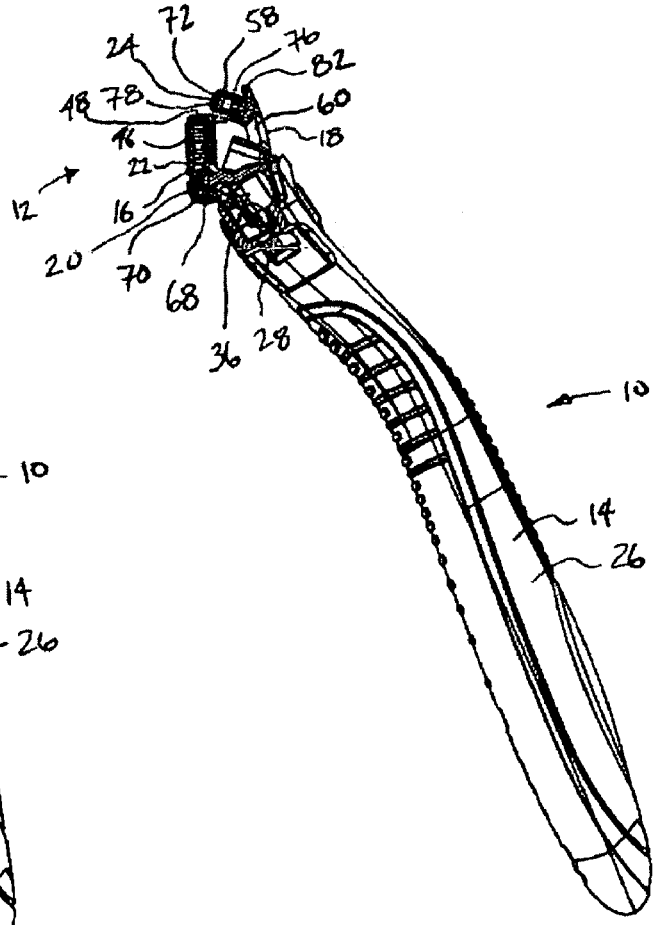
FIG. 7 is a sectional view of FIG. 3 along line VII-VII.
Figure 8:
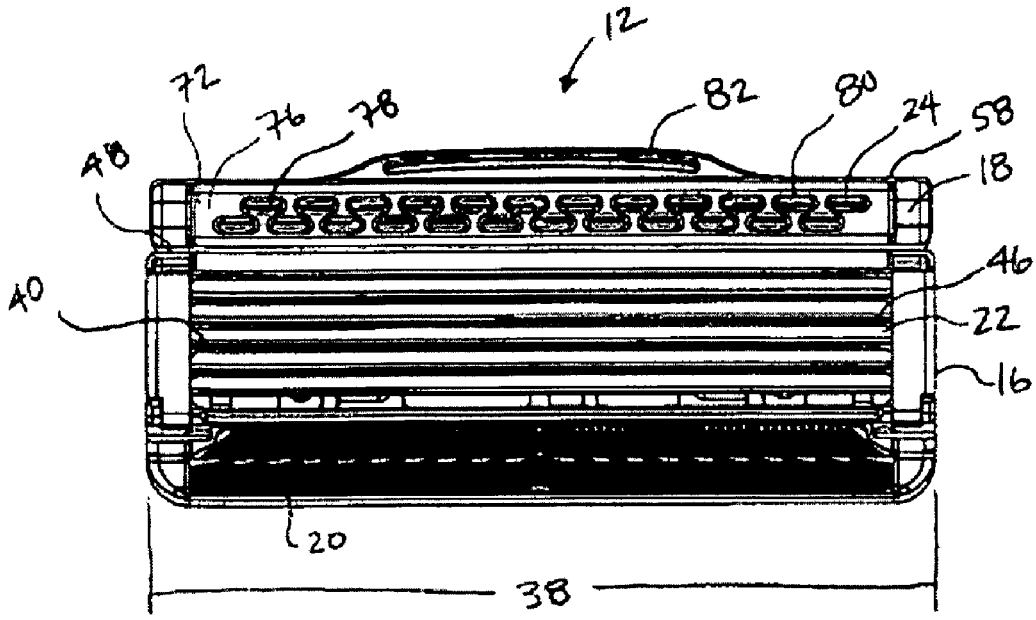
FIG. 8 is a front view of one embodiment of a shaving cartridge of the present invention.

Locking means 88 are also provided in order to lock the separable lubrication 18 in the locked position (see e.g., FIGS. 6 and 7). The locking means 88 can be of any type that maintains the position of the separable lubrication 18 in the locked position. For example, the cartridge spring 84 can be positioned such that, once the separable lubrication 18 has pivoted to a pre-determined angle, a toggling action occurs and the cartridge spring 84 biases the separable lubrication 18 into the locked position, rather than towards the neutral position.

Figure 14:
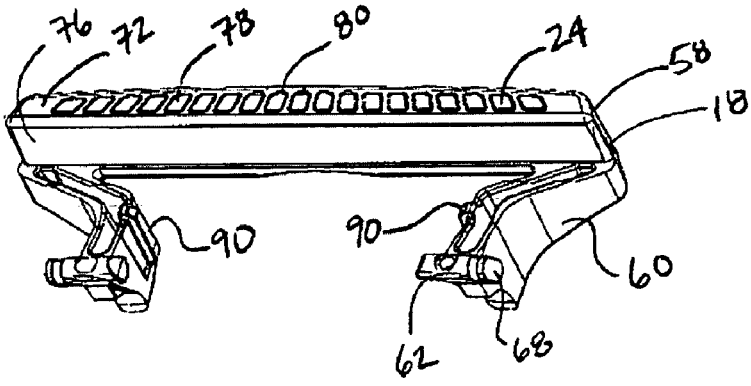
FIG. 14 is an isometric view of one embodiment of the separable lubrication having pins.
Figure 15:
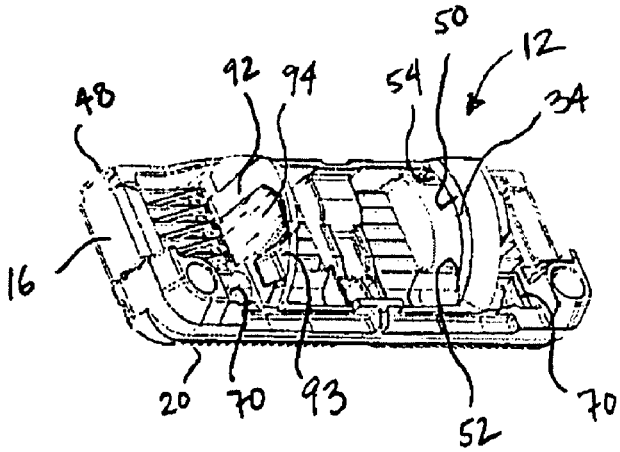
FIG. 15 is an isometric view of one embodiment of the frame having forward position detents and locked position detents.

Alternatively, in another embodiment, as shown in FIGS. 14 and 15, the separable lubrication can be generally locked in the forward position and the locked position. In the embodiment shown in FIGS. 14 and 15, the arms of the separable lubrication include raised pins that mate with matching indents that are positioned in pre-determined locations that define the forward position and the locked position. A plateau separates the forward position indents from the rearward position indents. During normal shaving, the pins on the arms of the separable lubrication are positioned, by the user, in the forward position indents. In preparation for trimming, the user manually rotates the separable lubrication toward the locked position. As the separable lubrication moves from the forward position to the rearward position, the pins are forced to pass over the plateau separating the forward position indents from the locked position indents. The pins reside on the plateau until the separable lubrication has been rotated sufficiently relative to the frame that the pins arrive and come to rest within the locked position indents. The reverse action takes place when returning the separable lubrication to the forward position.

When the shaving implement 10 is at rest, the frame biasing means 56 biases the frame 16 towards the neutral position, as shown in FIG. 1. Simultaneously, in some embodiments, such as the one shown in FIGS. 9-11, the cartridge spring 84 biases the separable lubrication 18 toward the forward position such that the skin-engaging member 72 of the top portion 58 is generally co-planar with the blade(s) 22. In other embodiments, such as the one shown in FIGS. 14-15, the separable lubrication can be generally locked in the forward position such that the skin-engaging member of the top portion is generally co-planar with the blade(s).

During shaving, the frame 16 and the separable lubrication 18, under the normal forces encountered, can pivot (generally) together between the neutral position and the rearward position. The blade(s) 22 shave the skin and the separable lubrication 18 provides shaving aid 24 to the recently shaved skin. In some embodiments, the separable lubrication may also pivot relative to the frame during normal shaving; in other embodiments, the separable lubrication is generally locked in the forward position and does not pivot relative to the frame during normal shaving.

In preparation for trimming, a user typically places his or her finger on, for example, the tab 82 and pulls back on the separable lubrication 18. In response to the force applied by the user, the frame 16 and the separable lubrication 18 pivot relative to the handle 14 until the frame reaches the rearward position. As the user continues to pull back on the tab 82, the separable lubrication 18 continues to pivot relative to the frame 16 until the front surface 64 of the arm 60 contacts the substantially flat wall 36 of the handle 14 and the pins 68 pull on the frame. As the separable lubrication 18 is moved into the locked position, the locking means 88 engage and hold the separable lubrication 18 in the locked position and the front surface 64 and pins 68 press the frame 16 forward toward the frame lock position, which can be at or near the neutral position. Therefore, when the separable lubrication 18 is in the locked position, the pivotal motion of the shaving cartridge 12 is limited, or, in some embodiments, fully eliminated by the positioning of the separable lubrication 18. With the frame 16 partially, or fully, immobilized, and the top portion 58 of the separable lubrication pivoted away from the rear edge 48 of the frame 16, the user can easily trim hard to reach areas because, inter alfa, the frame 16 does not pivot, or pivots less, and the separable lubrication 18 is positioned away from the rear edge 48 of the frame 16 and the rear edge of the frame is the rearward most feature on the shaving implement contacting the skin.

While various embodiments have been described above, it should be understood that they have been presented by way of example only, and not limitation. For instance, modifications or changes as can be made within the scope of the attached claims and features disclosed in connection with any one embodiment can be used alone or in combination with each feature of the respective other embodiments. Thus, the breadth and scope of any embodiment should not be limited by any of the above described exemplary embodiments, but should be defined only in accordance with the following claims and their equivalents.

What is claimed is:

1. A shaving implement, comprising:

a handle; and a shaving cartridge, the shaving cartridge includes a frame, a separable lubrication, and means for locking;

wherein the frame defines a length and a rear edge;

wherein the frame is pivotally mounted on the handle and includes at least one blade having a cutting edge, the frame being capable of pivoting between a neutral position and a rearward position;

wherein the separable lubrication has at least one arm and a top portion, and the separable lubrication is pivotal relative to the frame between a forward position and a locked position, wherein at least a portion of the top portion of the separable lubrication is aft of and adjacent to the rear edge of the frame when in the forward position and is in contact with the skin during normal shaving;

wherein the means for locking locks the separable lubrication in the locked position such that the top portion of the separable lubrication is positioned further away from the rear edge of the frame compared to when the separable lubrication is in the forward position and, when the separable lubrication is in the locked position, the separable lubrication is not in contact with the skin during normal shaving; and wherein the frame is forced toward the neutral position when the separable lubrication is pivoted toward the locked position and the frame is limited from pivoting when the separable lubrication is in the locked position.

2. The shaving implement of claim 1, wherein the pivotal motion of the frame is substantially limited when the separable lubrication is in the locked position.

3. The shaving implement of claim 1, wherein the rear edge of the frame is within 3 mm of the cutting edge of the aft-most blade.

4. The shaving implement of claim 1, wherein the rear edge of the frame is within 2 mm of the cutting edge of the aft-most blade.

5. The shaving implement of claim 1, wherein the rear edge of the frame is made of metal.

6. The shaving implement of claim 1 wherein the frame is in a frame lock position when the separable lubrication is in the locked position.

7. The shaving implement of claim 6, wherein the frame lock position is located between the neutral position and the rearward position.

8. The shaving implement of claim 7, wherein the frame lock position is located near the neutral position.

9. The shaving implement of claim 1, wherein the portion of the top portion of the separable lubrication in contact with the skin during normal shaving is the skin contacting portion, and the skin contacting portion includes a shaving aid.

10. The shaving implement of claim 9, wherein the shaving aid is in the form of a shaving aid strip.

11. The shaving implement of claim 9, wherein the shaving aid is included in an inner core that is at least partially surrounded by a plastic outer shell, where the inner core at least partially fills the outer shell.

12. The shaving implement of claim 11, wherein the outer shell includes at least one hole that permits water to enter into the plastic outer shell, mix with the shaving aid, and then exit back through the at least one hole during normal shaving.

13. The shaving implement of claim 1, further including a spring that, during normal shaving biases the separable lubrication toward the forward position.

14. The shaving implement of claim 1, wherein one of the at least one arm of the separable lubrication and the frame include a pin and the other of the at least one arm of the separable lubrication and the frame include a forward position recess and a locked position recess such that, when the separable lubrication is in the forward position, the pin is located in the forward position recess and, when the separable lubrication is in the locked position, the pin is located in the locked position recess.

15. the shaving implement of claim 14, wherein the means for locking includes the pin.

* * * * *